US005394933A

United States Patent [19]

Takayanagi

[11] Patent Number: 5,394,933

[45] Date of Patent: Mar. 7, 1995

[54] CORE FOR CASTING TITANIUM AND TITANIUM ALLOY

[75] Inventor: Takeshi Takayanagi, Aichi, Japan

[73] Assignees: Agency of Industrial Science & Technology; Ministry of International Trade & Industry, Tokyo, Japan

[21] Appl. No.: 34,381

[22] Filed: Mar. 18, 1993

[30] Foreign Application Priority Data

Jun. 19, 1992 [JP] Japan ..... 4-186007

[51] Int. Cl.[6] ..... B27C 1/06; B27C 3/00

[52] U.S. Cl. ..... 164/369; 164/138; 164/529

[58] Field of Search ..... 164/369, 529, 138

[56] References Cited

FOREIGN PATENT DOCUMENTS 63-140740 6/1988 Japan ..... 164/529

2-200345 8/1990 Japan ..... 164/529

*Primary Examiner*—Kuang Y. Lin

*Attorney, Agent, or Firm*—Oblon, Spivak, McClelland, Maier, & Neustadt

[57] ABSTRACT

A core for casting titanium or an alloy thereof consists essentially of a sintered formed substrate of a powder having as its main component either mullite powder alone or a combination of mullite powder and at least one member selected from among quartz glass, alumina, zircon, magnesia, and cristobalite and a surface layer formed of at least one member selected from among yttria, zirconia, hafnia, alumina, neodymium oxide, and samarium oxide and deposited as a coating layer on the surface of the formed substrate.

20 Claims, No Drawings

CORE FOR CASTING TITANIUM AND TITANIUM ALLOY

BACKGROUND OF THE INVENTION

1. Field of the Invention

Titanium and alloys thereof have high melting points and high specific strengths and exhibit excellent resistance to oxidation at high temperatures up to 800° C. and, owing to these outstanding qualities, are used as high-temperature structural materials and for the production of aerospace parts. Further, since they exhibit excellent resistance to the corrosion of acids and alkalis, they are used in the components of chemical equipment which handle such corrosive solutions.

This invention relates to cores for use in casting hollow parts made of titanium and alloys thereof.

2. Prior Art Statement

The present inventor investigated the core for casting of titanium and alloys thereof. These metals have high melting points, manifest activity at elevated temperatures, and react readily with refractory materials. As raw materials for cores for use in casting titanium and alloys thereof, alumina, calcia, and other materials using such metal oxides as a main component have been studied. Since calcia readily reacts with moisture in the atmosphere, cores made of calcia cannot easily retain their shape and stability. Cores of alumina have a problem in that they are difficult to remove from the cast products. No core effectively usable for the casting of titanium and alloys thereof has been developed to date. Since titanium and alloys thereof manifest outstanding mechanical properties even at high temperatures, it is desired to develop a core suitable for titanium and titanium alloy castings.

SUMMARY OF THE INVENTION

The present inventor continued a study aimed at developing a core which satisfies this desire.

To be specific, this invention is directed to a core for use in casting titanium and alloys thereof, which core consists essentially of a sintered shaped substrate of a powder having mullite powder as a main component and a layer made of at least one metal oxide selected from among yttria, zirconia, hafnia, alumina, neodymium oxide, and samarium oxide and deposited to coat the surface of the shaped substrate.

DESCRIPTION OF THE PREFERRED EMBODIMENTS

The casting core of this invention is produced by the following method. A refractory powder formed solely of mullite or composed of mullite in combination with quartz glass, zirconia, alumina, magnesia, and/or cristobalite is prepared and preformed in the general shape of a desired core but very slightly smaller than the exact size the core is required to possess.

To be more specific, the preform is manufactured by mixing the refractory powder with such additives as wax, stearic acid, oleic acid, and polyethylene and molding the produced mixture by application of heat and pressure. The application of heat and pressure in this case is required to be such that the preform of the mixture consequently obtained will not be deformed by any external shock exerted thereon in the process of transportation. Then, the preform obtained as described above is deprived of the additives mentioned above and sintered.

The reason for the incorporation of the additives in the refractory powder is as follows.

The wax and polyethylene function as binders in the preform and the oleic acid and stearic acid serve respectively as a plasticizer and a lubricant for the molding of the preform.

The mullite possesses enough refractoriness to withstand the heat used for casting titanium and alloys easy growth of needle type crystals. The sintered article of mullite, therefore, excels in strength and resistance to creep at elevated temperatures and is highly immune to high-temperature deformation. Thanks to these properties of the mullite constituting a main refractory component of the core, the core can be used to accurately form a hollow part in a cast product. Mullite of a slightly low purity manifests a relatively high sintering property and, therefore, permits production of a sintered core with excellent properties. Mullite of high purity does not sinter easily and, therefore, may result in a sintered core of insufficient strength. When high-purity mullite is used, therefore, sintering-accelerator such as quartz glass, zirconia, alumina, magnesia, and/or cristobalite are incorporated to increase the strength of the sintered core produced. The sintered core produced from the refractory powder of mullite incorporating the sintering-accelerator enjoys easy release from the cast product.

The sintered article mentioned above, however, reacts with the melt of titanium or alloy thereof (temperature 1,700° C. to 1,780° C.). The core of this invention, therefore, comprises the sintered article mentioned above and a coating of yttria, zirconia, alumina, neodymium oxide, or samarium oxide deposited on the surface of the sintered article. The coating reacts only sparingly with the melt of titanium or titanium alloy.

In the refractory powder to be used for the production of the preform compacts in the manufacture of the core, the amount of the additives incorporated in the refractory powder is 15 to 30% by weight, based on the amount of the refractory powder.

The amount of the oxide added to the mullite for the purpose of improving the sinterability of the mullite may be selected in the range of from 0.5 to 30% by weight based on the amount of mullite, depending on the sinterability of the mullite being used.

The coating formed on the sintered article using mullite substantially as a main component is at least one member selected from the group of compounds enumerated above.

Though the thickness of the coating thus formed is not particularly limited, it is desired to be in the range of from 20 to 200 μm.

This invention will now be described more specifically below with reference to working examples.

EXAMPLE 1

A plate-like core specimen was obtained by preparing a homogeneous mixture consisting of 500 g of mullite powder, 80 g of micro-crystalline wax, and 10 g of stearic acid and injecting the mixture into the metal die at 70° C. and 8 kgf/cm$^2$. This specimen was buried in alumina powder and maintained at 500° C. for 24 hours to remove the wax and stearic acid. It was then sintered at 1,400° C. for one hour and thereafter cooled to normal room temperature. The sintered specimen was immersed in yttria sol for coating the surface thereof with the sol. The sintered specimen thus coated with the sol was maintained at 1,000° C. for 30 minutes to deprive the sol of a flammable component. As a result, a yttria coating layer 30 μm in thickness was formed on the surface of the sintered specimen. Then, the sintered specimen with the yttria coating layer was immersed as a core in a melt of titanium at 1,770° C. for 20 minutes, whereafter the melt was cooled. As a result, a cast product of titanium enclosing the core was obtained. The cast product was sectioned. When the interface between the cast product and the core appearing in the cross section was microscopically examined, the reacted layer on the titanium side was found to be less than 5 μm in thickness.

EXAMPLE 2

A preformed core for a pump impeller was obtained by preparing a homogeneous mixture consisting of 475 g of mullite powder, 25 g of quartz glass powder, 80 g of a paraffin wax, 10 g of stearic acid, and 2 g of oleic acid and injecting the mixture into the metal die at 65° C. and 6 kgf/cm$^2$. The preformed core was buried in alumina powder and maintained at 500° C. for 24 hours to deprive the core of the wax, stearic acid, and oleic acid. Then, the preformed core was sintered at 1,250° C. for one hour and cooled to normal room temperature. The sintered core consequently obtained was immersed in yttria sol to coat the surface of the sintered core with the sol. The coated core was maintained at 1,000° C. for 30 minutes to deprive the sol coating of the flammable content. As a result, a yttria coating layer 30 μm in thickness was formed on the surface of the sintered core. In an investment shell mold for the production of a pump impeller, the sintered core provided with the yttria coating layer was set in place and then a Ti-6Al-4V alloy at 1,750° C. was poured and left cooling, to obtain a cast product of titanium alloy enclosing the core. This cast product was sectioned. When the interface between the cast product and the core appearing in the cross section was microscopically examined, the reacted layer on the titanium alloy side was found to be less than 5 μm in thickness.

EXAMPLE 3

A preformed core for forming a hollow cooling path in a blade was obtained by preparing a homogeneous mixture consisting of 470 g of mullite powder, 30 g of zircon powder, 80 g of paraffin wax, 5 g of polyethylene, 10 g of stearic acid, and 2 g of oleic acid and injecting this mixture into the metal die at 75° C. and 8 kgf/cm$^2$. The preformed core was buried in alumina powder and maintained at 500° C. for 24 hours to be deprived of the wax, stearic acid, and oleic acid. Then, the preformed core was sintered at 1,300° C. for one hour and cooled to normal room temperature. The sintered core was immersed in zirconia sol to coat the surface of the sintered core with the sol. It was then maintained at 1,000° C. for 30 minutes to deprive the sol of the flammable component. As a result, a zirconia coating layer 50 μm in thickness was formed on the surface of the sintered core (sintered composite of mullite and zircon). In an investment shell casting mold for the production of a blade, the sintered core provided with the zirconia coating layer was set in place and then a Ti-6Al-4V alloy at 1,750° C. was poured and cooled. Consequently, a cast product of the titanium alloy enclosing the core was obtained. The cast product was sectioned. When the interface between the cast product and the core appearing in the cross section was microscopically examined, the reacted layer on the titanium alloy side was found to be less than 20 μm.

EXAMPLE 4

A preformed core for forming a hollow cooling path in a blade was obtained by preparing a homogeneous mixture consisting of 470 g of mullite powder, 30 g of alumina powder, 75 g of a paraffin wax, 10 g of polyethylene, 10 g of stearic acid, and 2 g of oleic acid and injecting this mixture into the metal die at 75° C. and 8 kgf/cm$^2$. The preformed core was buried in alumina powder and maintained at 500° C. for 24 hours to be deprived of the wax, stearic acid, and oleic acid. Then, the preformed core was sintered at 1,300° C. for one hour and cooled to normal room temperature. The sintered core consequently obtained was immersed in zirconia sol to coat the surface of the sintered core with the sol. It was then maintained at 1,000° C. for 30 minutes to deprive the sol of the flammable component. As a result, a zirconia coating layer 45 μm in thickness was formed on the surface of the sintered core. In an investment shell mold for the production of a blade, the sintered core provided with the zirconia coating layer was placed and then a Ti-5Al-2Sn alloy at 1,750° C. was poured and cooled. As a result, a cast product of the titanium alloy enclosing the core was obtained. The cast product was sectioned. When the interface between the cast product and the core appearing in the cross section was microscopically examined, the reacted layer on the titanium alloy side was found to be less than 30 μm in thickness.

EXAMPLE 5

A preformed core for forming a hollow part in a valve body was obtained by preparing a homogeneous mixture consisting of 470 g of mullite powder, 20 g of zircon powder, 10 g of alumina powder, 70 g of a paraffin wax, 5 g of polyethylene, 10 g of stearic acid, and 2 g of oleic acid and injecting this mixture into the metal die at 75° C. and 8 kgf/cm$^2$. This preformed core was buried in alumina powder and maintained at 500° C. for 24 hours to be deprived of the wax, stearic acid, and oleic acid. Then, the preformed core was sintered at 1,300° C. for one hour and cooled to normal room temperature. The sintered core obtained consequently was immersed in an alumina-containing yttria sol to coat the surface of the sintered core with the sol. It was then maintained at 1,000° C. for 30 minutes to deprive the sol of the flammable component. AS a result, an alumina-containing yttria coating layer 30 μm in thickness was formed on the surface of the sintered core (composite of mullite, alumina, and zircon). In an investment shell casting mold for the production of a valve, the sintered core provided with the coating layer was set in place and then a Ti-6Al-4V alloy at 1,750° C. was poured and cooled. Consequently, a cast product of the titanium alloy enclosing the core was obtained. This cast product was sectioned. When the interface between the cast product and the core appearing in the cross section was microscopically examined, the reacted layer on the titanium alloy side was found to be less than 10 μm in thickness.

EXAMPLE 6

A preformed core for forming a hollow cooling path in a blade was obtained by preparing a homogeneous mixture consisting of 460 g of mullite powder, 30 g of zircon powder, 10 g of alumina powder, 80 g of a paraffin wax, 5 g of polyethylene, 10 g of stearic acid, and 2 g of oleic acid and injecting this mixture into the metal die at 75° C. and 8 kgf/cm$^2$. This preformed core was buried in alumina powder and maintained at 500° C. for 24 hours to be deprived of the wax, stearic acid, and oleic acid. Then, this preformed core was sintered at 1,300° C. for one hour and then cooled to normal room temperature. The sintered core consequently obtained was immersed in neodymium oxide sol to coat the surface of the sintered core with the sol and maintained at 1,000° C. for 30 minutes to deprive the sol of the flammable component. As a result, a neodymium oxide coating layer 30 μm in thickness was formed on the surface of the sintered core (composite of mullite, alumina, and zircon). In an investment shell casting mold for the production of a blade, the sintered core provided with the neodymium oxide coating layer was set in place and then a Ti-6Al-4V alloy at 1,750° C. was poured and cooled. Consequently, a cast product of the titanium alloy enclosing the core was obtained. This cast product was sectioned. When the interface between the cast product and the core appearing in the cross section was microscopically examined, the reacted layer on the titanium alloy side was found to be less than 20 μm in thickness.

EXAMPLE 7

A preformed core for forming a hollow cooling path in a pump impeller was obtained by preparing a homogeneous mixture consisting of 460 g of mullite powder, 35 g zircon powder, 5 g of magnesia powder, 80 g of a paraffin wax, 10 g of polyethylene, 10 g of stearic acid, and 2 g of oleic acid and injecting this mixture into the metal die at 75° C. and 8 kgf/cm$^2$. This preformed core was buried in alumina powder and maintained at 500° C. for 24 hours to be deprived of the wax, stearic acid, and oleic acid. Then, this preformed core was sintered at 1,300° C. for one hour and then cooled to normal room temperature. The sintered core consequently obtained was immersed in neodymium oxide sol to coat the surface of the sintered core with the sol. It was then heated at 1,000° C. for 30 minutes to deprive the sol of the flammable component. As a result, a neodymium oxide coating layer 25 μm in thickness was formed on the surface of the sintered core (composite of mullite, magnesia, and zircon). In an investment shell casting mold for the production of a pump impeller, the sintered core provided with the neodymium oxide coating layer was set in place and then a Ti-6Al-4V alloy at 1,750° C. was poured and cooled. Consequently, a cast product of the titanium alloy enclosing the core was obtained. This cast product was sectioned. When the interface between the cast product and the core appearing in the cross section was microscopically examined, the reacted layer on the titanium alloy side was found to be less than 20 μm in thickness.

EXAMPLE 8

A preformed core for forming a hollow cooling path in a blade was obtained by preparing a homogeneous mixture consisting of 460 g of mullite powder, 30 g of zircon powder, 10 g of cristobalite powder, 80 g of a paraffin wax, 5 g of polyethylene, 10 g of stearic acid, and 2 g of oleic acid and injecting this mixture into the metal die at 75° .C and 8 kgf/cm$^2$. This preformed core was buried in alumina powder and maintained at 500° C. for 24 hours to be deprived of the wax, stearic acid, and oleic acid. Then, this preformed core was sintered at 1,300° C. for one hour and cooled to normal room temperature. The surface of the sintered core consequently obtained was coated with samarium oxide by the PVD vacuum deposition method. The coated core was maintained at 1,000° C. for 30 minutes. As a result, a samarium oxide coating layer 50 μm in thickness was formed on the surface of the sintered core. In an investment shell casting mold for the production of a wing, the sintered core provided with the samarium oxide coating layer was set in place and then a Ti-6Al-4V alloy at 1,750° C. was poured and cooled. Consequently, a cast product of the titanium alloy enclosing the core was produced. This cast product was sectioned. When the interface between the cast product and the core appearing in the cross section was microscopically examined, the reacted layer on the titanium alloy side was found to be less than 10 μm in thickness.

EXAMPLE 9

A preformed core for forming a hollow part in a valve body was obtained by preparing a homogeneous mixture consisting of 400 g of mullite powder, 80 g of quartz glass, 20 g of zircon powder, 90 g of a paraffin wax, 15 g of polyethylene, 10 g of stearic acid, and 2 g of oleic acid and injecting this mixture into the metal die at 75° C. and 8 kgf/cm$^2$. This preformed core was buried in alumina powder and maintained at 500° C. for 24 hours to be deprived of the wax, stearic acid, and oleic acid. Then, the preformed core was sintered at 1,300° C. for one hour and cooled to normal room temperature. The surface of the resultant sintered core was coated with hafnia by the electrostatic spray coating method and then maintained at 1,000° C. or 30 minutes. As a result, a hafnia coating layer 100 μm in thickness was formed on the surface of the sintered core (composite of mullite, silica, and zircon). In an investment shell casting mold for the production of a valve, the sintered core provided with the hafnia coating layer was set in place and then a Ti-6Al-4V alloy at 1,750° C. was poured and cooled. Consequently, a cast product of the titanium alloy enclosing the core was produced. This cast product was sectioned. When the interface between the cast product and the core appearing in the cross section was microscopically examined, the reacted layer on the titanium alloy side was found to be less than 10 μm in thickness.

EXAMPLE 10

A preformed core for forming a hollow cooling path in a bade was obtained by preparing a homogeneous mixture consisting of 450 g of mullite powder, 50 g of zircon powder, 90 g of a paraffin wax, 15 g of polyethylene, 10 g of stearic acid, and 2 g of oleic acid and injecting this mixture into the metal die at 75° C. and 8 kgf/cm$^2$. This preformed core was buried in alumina powder and maintained at 500° C. for 24 hours to be deprived of the wax, stearic acid, and oleic acid. Then, this preformed core was sintered at 1,300° C. for one hour and cooled to normal room temperature. The resultant sintered core was immersed in zirconia sol containing 5% by weight of yttria to coat the surface of the sintered core of mullite with the sol. It was maintained at 1,000° C. for 30 minutes to deprive the sol of the flammable component. As a result, a yttrium-containing zirconia coating layer 50 μm in thickness was formed on the surface of the sintered core (composite of mullite and silica). In an investment shell casting mold for the production of a blade, the sintered core provided with the coating layer was set in place and then a Ti-6Al-4V alloy at 1,750° C. was poured and cooled. As a result, a cast product of the titanium alloy enclosing the core was produced. This cast product was sectioned. When the interface between the cast product and the core appearing in the cross section was microscopically examined, the reacted layer on the titanium alloy side was found to be less than 30 μm in thickness.

The use of the core of this invention enables production of an accurately cast article of titanium or an alloy thereof possessing a hollow part of a complicated shape. Thus, this invention contributes to decreasing the weight of the cast article and to imparting improved quality thereto.

What is claimed is:

1. A core for casting titanium or an alloy thereof, consisting essentially of (A) a sintered formed substrate, comprising (i) mullite; and (ii) 0.5–30% by weight, based on the amount of said mullite, of at least one sintering accelerator selected from the group consisting of quartz glass, alumina, zirconia, magnesia and cristobalite; and (B) a layer made of at least one oxide selected from the group consisting of yttria, zirconia, hafnia, alumina, neodymium oxide and samarium oxide;

wherein said layer is on the surface of said substrate.

2. A core according to claim 1, wherein said layer has a thickness in the range of from 20 to 200 μm.

3. A core according to claim 1, wherein said layer comprises at least one member selected from the group consisting of mixtures of oxides and compound oxides.

4. A core for casting titanium or an alloy thereof, comprising (A) a sintered formed substrate, comprising (i) mullite; and (ii) 0.5–30% by weight, based on the amount of said mullite, of a sintering accelerator comprising one member selected from the group consisting of quartz glass, alumina, zirconia, magnesia and cristobalite; and (B) a layer comprising one oxide selected from the group consisting of yttria zirconia, hafnia, alumina, neodymium oxide and samarium oxide;

wherein said layer is on the surface of said substrate.

5. A core according to claim 4, wherein said layer has a thickness in the range of from 20 to 200 μm.

6. A core according to claim 4, wherein said layer comprises at least one member selected from the group consisting of mixtures of oxides and compound oxides.

7. A core according to claim 5, wherein said layer has a thickness in the range of from 25 to 100 μm.

8. A core according to claim 7, wherein said layer has a thickness in the range of from 30 to 50 μm.

9. A core according to claim 4, wherein said sintering accelerator comprises zirconia and one member selected from the group consisting of alumina, magnesia, quartz glass and cristobalite.

10. A core according to claim 4, wherein said substrate comprises 5 to 25% by weight, based on the amount of said mullite, of said sintering accelerator.

11. A core according to claim 10, wherein said substrate comprises 11 to25% by weight, based on the amount of said mullite, of said sintering accelerator.

12. A core according to claim 10, wherein said substrate comprises 5 to 11% by weight, based on the amount of said mullite, of said sintering accelerator.

13. A core according to claim 4, wherein said layer comprises one member selected from the group consisting of yttria, neodymium oxide and samarium oxide.

14. A core according to claim 4, wherein said layer comprises one member selected from the group consisting of zirconia and hafnia.

15. A core according to claim 4, wherein said layer comprises yttria and zirconia.

16. A core according to claim 4, wherein said layer comprises yttria and alumina.

17. A core according to claim 5, wherein said substrate comprises 5 to 25% by weight, based on the amount of said mullite, of said sintering accelerator.

18. A core according to claim 9, wherein said substrate comprises 5 to 25% by weight, based on the amount of said mullite, of said sintering accelerator.

19. A core according to claim 5, wherein said sintering accelerator comprises zirconia and one member selected from the group consisting of alumina, magnesia, quartz glass and cristobalite.

20. A core according to claim 7, wherein said sintering accelerator comprises zirconia and one member selected from the group consisting of alumina, magnesia, quartz glass and cristobalite.

* * * * *